US009156584B2

(12) United States Patent
Ban et al.

(10) Patent No.: US 9,156,584 B2
(45) Date of Patent: Oct. 13, 2015

(54) SEALING DISC FOR INDUCTION SEALING OF A CONTAINER

(71) Applicants: Nikolaus Ban, Hannover (DE); Peter Rothweiler, Freden an der Leine (DE); Heinz-Werner Rohrka, Geisenheim (DE); Rainer Kroger, Sehnde (DE)

(72) Inventors: Nikolaus Ban, Hannover (DE); Peter Rothweiler, Freden an der Leine (DE); Heinz-Werner Rohrka, Geisenheim (DE); Rainer Kroger, Sehnde (DE)

(73) Assignee: Alfelder Kunststoffwerke Herm. Meyer GmbH, Alfeld/Leine (DE)

( * ) Notice: Subject to any disclaimer, the term of this patent is extended or adjusted under 35 U.S.C. 154(b) by 0 days.

(21) Appl. No.: 14/379,815

(22) PCT Filed: Apr. 5, 2013

(86) PCT No.: PCT/EP2013/057199

§ 371 (c)(1),
(2) Date: Aug. 20, 2014

(87) PCT Pub. No.: WO2013/150137

PCT Pub. Date: Oct. 10, 2013

(65) Prior Publication Data

US 2015/0034647 A1 Feb. 5, 2015

(30) Foreign Application Priority Data

Apr. 5, 2012 (DE) ..... 10 2012 006 934

(51) Int. Cl.

| | |
|---|---|
| ***B65D 17/34*** | (2006.01) |
| ***B65D 51/20*** | (2006.01) |
| ***B65D 17/00*** | (2006.01) |

(52) U.S. Cl.

CPC ..... *B65D 17/161* (2013.01); *B65D 51/20* (2013.01); *B65D 2251/0015* (2013.01); *B65D 2251/0093* (2013.01)

(58) Field of Classification Search

CPC .... B65D 17/502; B65D 17/501; B65D 17/50; B65D 17/163; B65D 17/161; B65D 17/16; B65D 51/20

USPC ..... 220/359.3, 359.2, 359.1, 270, 268, 266, 220/265; 215/232, 254, 253, 250

See application file for complete search history.

(56) References Cited

U.S. PATENT DOCUMENTS

| | | | | |
|---|---|---|---|---|
| 3,199,705 | A * | 8/1965 | Brockett | 215/254 |
| 4,588,099 | A * | 5/1986 | Diez | 215/232 |
| 4,719,740 | A * | 1/1988 | Gach | 53/421 |

(Continued)

FOREIGN PATENT DOCUMENTS

| | | |
|---|---|---|
| DE | 91 08 868 | 9/1991 |
| DE | 199 20 572 | 11/2000 |
| DE | 10 2007 014 084 | 7/2008 |

(Continued)

*Primary Examiner* — Robert J Hicks
(74) *Attorney, Agent, or Firm* — Slater & Michaelson

(57) ABSTRACT

A sealing disc for closing mouths of containers has a foil for inductively introducing heat into the sealing disc. The sealing disc has an edge region. A sealing layer is provided on the side of the foil that is to face the interior of the container, for sealing tight the edge region of the sealing disc on the mouth of the container. One or more layers are located on the side of the foil that is remote from the sealing layer. Further, a hand grip is formed as part of the sealing disc and serves to open the mouth of the container that is closed by the sealing disc. On the side that is remote from the sealing layer, the layer or layers are provided with weakening lines for forming an outline of the hand grip. The weakening lines lead into the edge region of the sealing disc.

21 Claims, 3 Drawing Sheets

(56) References Cited

U.S. PATENT DOCUMENTS

| | | | | |
|---|---|---|---|---|
| 4,754,890 | A * | 7/1988 | Ullman et al. | 215/232 |
| 4,778,698 | A * | 10/1988 | Ou-Yang | 428/34.4 |
| 4,934,544 | A * | 6/1990 | Han et al. | 215/232 |
| 5,915,601 | A | 6/1999 | Ullrich et al. | |
| 6,474,490 | B1 | 11/2002 | Seibel et al. | |
| 6,974,045 | B1 * | 12/2005 | Trombach et al. | 215/232 |
| 2007/0007229 | A1 | 1/2007 | Yousif | |

FOREIGN PATENT DOCUMENTS

| | | |
|---|---|---|
| EP | 1 160 177 | 12/2001 |
| EP | 1 472 153 | 11/2004 |
| EP | 2 045 194 | 4/2009 |
| GB | 2 142 911 | 1/1985 |

* cited by examiner

SEALING DISC FOR INDUCTION SEALING OF A CONTAINER

TECHNICAL FIELD

The invention relates to a sealing disc for closing mouths of containers, having a foil for inductively introducing heat into the sealing disc, having an edge region of the sealing disc, having a sealing layer on the side of the foil that is to face the interior of the container, for sealing tight the edge region of the sealing disc on the mouth of the container, having one or more layers on the side of the foil that is remote from the sealing layer, having a hand grip that is formed as part of the sealing disc, for opening the mouth of the container that is closed by the sealing disc. Further, the invention relates to a container having a sealing disc of this kind.

BACKGROUND OF THE INVENTION

Containers serve to receive contents, for example to receive drinks or powder foodstuffs or other substances. On their upper side, the containers have an opening or mouth. It is frequently desirable or indeed necessary to close this container mouth with a disc-shaped seal which tightly closes off the contents from external influences, that is to say with a sealing disc.

Already known from DE 91 08 868 U1 is a sealing disc which is for closing a container and can be secured to the opening edge of the container by induction sealing. For this purpose, the sealing disc has a metal foil. A very thin plastics foil is mounted on the underside of the metal foil, that is to say on the side adjacent to the opening edge. It is then possible to mount this foil securely to the upper edge by means of induction sealing. If an eddy current is induced in the metal foil from above, the latter is heated accordingly, as is the plastics foil which is located under it and which is thereby melted. This also applies to the upper edge of the container, for example a plastics beaker. A relatively secure connection between the plastics foil and the upper edge of the beaker is produced. The entire mouth region is then additionally covered with a screw cap which mechanically protects the sealing disc and the mouth region.

In order to reach the contents of a container which is still closed by the sealed-on sealing disc, the user must remove the sealing disc in a suitable form from the mouth. For this purpose, there are various hand grips used in practice to simplify this procedure for the user.

DE 10 2007 014 084 B3 discloses for example an outwardly projecting grip tab. This protrudes beyond the opening edge of the container. The user can grasp this grip tab, pull it upward and then remove the sealing disc in one movement.

This concept is widely used and has indeed proved itself in practice. It is disadvantageous that the grip tab that projects outwards beyond the radius of the mouth of the container must be accommodated, before the actual time at which it is needed and used, as far as possible such that on the one hand it is not itself damaged and so can no longer fulfill its purpose, and on the other it does not disrupt the closing procedure. Another consideration is that frequently a screw cap has to be screwed onto and over the mouth of the container, on the outside, and outwardly projecting sealing tabs then have to be designed such that as far as possible they do not enter the screw thread and either impair the seal or become engaged by the thread themselves. There are ways of tackling this, but some of these require a burdensome adaptation of the screw cap or, as in EP 2 045 194 B1, require a complicated folding back of this tab into the interior of the sealing disc, between other layers.

Another idea, as in EP 1 472 153 B1 or DE 199 20 572 A1, consists in forming the uppermost layer of the sealing disc such that it forms a type of upwardly projecting fold which the user can grasp in order to pull the entire sealing disc off upwards.

This construction, which is also widely used, has the disadvantage that the uppermost layer may either be bonded to the layer underneath not over the full surface or may be secured thereto in order that a loose, upwardly projecting and graspable fold is indeed produced, or that the uppermost layer is from the outset formed by additional material, such that it forms with this additional material an upwardly projecting layer that leads back to the base of the fold again.

In both cases, the problem arises that this fold, which then projects loosely upwards, is sensitive to rotary movements of the screw cap thereon and measures have to be taken to protect the fold from damage, despite the fact that it lies loosely on the layers underneath. Moreover, the formation of folds of this kind using partial regions of the surface of the sealing disc is not unproblematic and is thus burdensome.

A further idea is known from EP 1 160 177 B1 and U.S. Pat. No. 5,915,601 A. Here, the attempt is made to provide, in a similar form, in the central region of the upper side of the sealing disc a hand grip for the user that he or she can pull on in order to lift up the sealing disc as a whole. For this purpose, a perforation is provided which delimits on three sides an approximately rectangular piece of the surface in the central region, on the upper side of the sealing disc. The user can then in part isolate this piece of the surface in the weakest region by separating it along the perforation, grasp it and lift it and, by way of the remaining piece connecting the rectangular surface to the rest of the sealing disc, attempt to use this piece of the surface as a hand grip and pull the entire sealing disc off upwards.

However, this is not unproblematic, since it is very difficult for the user to predict and control the precise behaviour of the sealing disc. Moreover, the points at which the force from pulling up the tab that is formed is introduced into the rest of the sealing disc are highly unfavourable and may result in uncontrolled tearing off at a point which may be undesirable.

If an upwardly projecting fold or outwardly jutting tab is dispensed with and the user is given no hand grip for the purpose of opening, then the user must try to destroy the sealing disc by force using a knife or other object, or in some cases using his or her fingers, in order to reach the contents. This is frequently unappealing to users and results in the container contents being spilled, since in this case these opening procedures are uncoordinated and are also difficult for the manufacturer of the respective product to predict.

This situation is very unsatisfactory. It would therefore be highly desirable if there were a way of providing users with a hand grip without needing to provide folds or similar that can be set upright or are upright for the purpose of being pulled up, or outwardly projecting or fold-up tabs.

SUMMARY OF THE INVENTION

It is therefore the object of the invention to propose such a sealing disc.

This object is achieved by means of the invention in the case of a sealing disc of the above type in that, on the side of the foil that is remote from the sealing layer, at least one of the layers is provided with weakening lines for forming an outline of the hand grip, and in that at least one of the weakening lines leads into the edge region of the sealing disc.

It is particularly preferable if, on the side that is remote from the sealing layer, at least one of the layers has a perforation which has a linear arrangement of individual perforation holes and which takes the form of an opening aid.

In practice, the user is faced with a container in which the mouth of the container is closed by a sealing disc according to the invention. The user then unscrews the screw cap which is provided in the majority of implementations and is looking directly at the upper side of the sealing disc. There, he or she sees the perforation, which may well also be highlighted by being coloured. Thus the function is clear to the user, since he or she will be familiar with perforations or other weakening lines from other applications.

The user then pushes through the sealing disc in the region of the hand grip, which is readily possible because of the weakening line or perforation.

Because of the weakening provided, the behaviour of the sealing disc is highly predictable to both users and companies filling the containers with contents. Consequently, unintentional spillage of the container contents does not occur, and nor is the user faced with the unexpected situation of for example putting a finger into the contained material as a result of a, for the user, unpredictable too small or too great resistance, or not being able to push through the sealing disc at the intended point.

After it has been pushed through, the sealing disc is accordingly opened in the region of the perforation. The user can grasp the hand grip that he or she has pushed in the direction of the container interior. The user then pulls on this hand grip, which in a preferred embodiment was surrounded by a weakening line that led into the edge region of the sealing disc on both sides of the hand grip. This means that, in this embodiment, the entire hand grip is simply taken and pulled away from the edge of the mouth.

This is readily possible and requires no exertion of force, since all that needs to be done is to overcome the sealing of a particular section in the edge region, for which the force is also given the optimum direction. It is thus possible without difficulty to remove the region of the hand grip of the sealing disc from the mouth of the container without any residue.

Since the perforation also results in a clean peripheral edge, a precisely predetermined and optimised surface region for the container mouth is opened up for the user.

In the case of a drinks container, for example, this may be a surface region that is optimised for enjoyment of the drink. It may also be a region that from the point of view of size is optimised for the insertion of a teaspoon. In all these cases, the rest of the container mouth remains closed, and so there is avoided an excessively large opening that may not be desirable to the user, who may instead wish to keep it small specifically in order to better control the container contents. If the user wishes otherwise, he or she may of course also easily pull off the rest of the sealing disc, since corresponding simple possibilities are now available as a result of the hole that has already been made.

In another embodiment of the cut shape, in which only one end of the weakening line, or one end of one of the weakening lines, leads into the edge region, other, also precisely predeterminable and reproducible ways for the sealing disc to behave are to be achieved. For example, when a weakening line of this kind is separated it is possible to enable access by the user such that the edge region of the sealing disc may successively be pulled off upwards all the way around, once again through direct and, from the point of view of force, particularly favourable access.

In the case of conventional constructions that operate with perforations or weakening lines, such as those in EP 1 160 177 A2 and U.S. Pat. No. 5,915,601 A, this is not possible. There, a surface piece in the interior of the sealing disc is turned into a kind of tab or hand grip, and thereafter can only be pulled off upwards. This is very unfavourable, since in that case only the direction of force from the container mouth vertically upwards is available to the user, but this specifically does not allow it to be pulled off the container mouth cleanly. Depending on the concrete construction of the cut shape, that is the line followed by the weakening lines or perforation, the user can now grasp the hand grip that he or she pushes in the direction of the container interior and either bring it back upwards again and pull it off, or pull on the hand grip and, with a different construction of the cut pattern, pull the entire sealing disc off the opening edge around the mouth of the container.

Consequently, depending on the embodiment, the user either opens up the entire mouth or, within the sealing disc, an opening predetermined by the perforation.

The size of this reduced opening too may be precisely predetermined by the shape of the cut pattern. For example, for conventional containers, such as in the case of foodstuffs, a size will be chosen which is suitable for a withdrawal procedure that is fitting for the product. For example, in the case of powder foodstuff contents, it is useful to provide for instance an opening that allows a teaspoon to be introduced and withdrawn.

It is particularly preferable if the sealing disc is provided on the side of the induction layer remote from the interior of the container—that is to say the side of the foil for inductively introducing heat into the sealing disc that is remote from the opening edge—with one or more layers that provide a reinforcement. This layer is then given, by means the weakening line or perforation, a predetermined break point which then for its part forms the customer-friendly opening aid.

Here, it is particularly preferable if this reinforcing layer is built up by the layers on the side of the foil remote from the sealing layer having a foil of polyethylene terephthalate (PET foil) and/or a foil of monoaxially oriented polypropylene (MOPP foil) and/or a foil of biaxially oriented polypropylene (BOPP foil) and/or a foil of oriented polyamide (OPA foil).

It has proved useful to use only one of these foils, which are listed as alternatives, so for example to apply a polyethylene terephthalate foil, for example by extrusion lamination or another type of lamination. A primer or laminating adhesive may for instance be laid between the induction layer and this PET foil.

The thickness of the layer of this PET foil is in this case preferably between 5 μm and 50 μm. The preferred quantity of primer or laminating adhesive is 0.5 to 5 $g/m^2$ dry.

As an alternative to the PET foil, a BOPP foil or MOPP foil may be provided, again preferably by extrusion lamination or another type of lamination. Here too, a primer or laminating adhesive may be laid between the induction layer and this reinforcing layer, and here too a quantity of 0.5 to 5 $g/m^2$ dry is preferred. The thickness of this BOPP foil or MOPP foil is also preferably between 5 μm and 50 μm.

As a further alternative, it is useful to apply an OPA foil as the reinforcing layer on the side of the induction layer opposite to the opening edge of the container mouth, that is to say preferably having a metal foil, in particular an aluminium foil, once again for instance by extrusion lamination or another type of lamination. Here too, a primer or laminating adhesive may be laid between the induction layer and the OPA foil.

Here too, the quantity is preferably between 0.5 and 5 g/m$^2$ dry. The thickness of the OPA foil is preferably between 8 μm and 50 μm.

In addition, a release coating may be applied to the reinforcing layer having the weakening line or in particular the perforation. This enables particularly good separation of further layers, which will be described below.

This release coating, or indeed the foil itself, may be provided with additional customer-friendly printing, for example pictograms indicating pushing through and pulling off, or a corresponding labeling or indeed other indications, for example along the perforation, that may make it easier for customers to understand the procedure.

The sealing discs are given a shape that corresponds to the size of the mouth of the container and are thus generally preferably round, in particular being circular. They may be inserted by the manufacturer of the seals and the containers without additional work, since the actual positioning of the perforation in relation to the container edge is insignificant. Thus, it is not important where, for instance, a particular winding of the thread acts, nor need any account be taken of a particular cutout, for instance for tabs or folds in the container lid.

It is also insignificant how the container itself is shaped, provided the mouth of the container can be reached by the user.

The side of the sealing disc opposite the container mouth is provided with sealing layers that may be adapted to the corresponding choice of material of the container. For example, a seal for containers made from either glass or different plastics (HDPE, LDPE, PP, PET or PVC) is possible. The sealing layers may be adjusted to be securely sealing or peelable, and have a thickness of preferably between 3 μm and 100 μm.

The induction layer or induction foil itself, which carries this sealing layer on the one side and the reinforcing layer on the other side, is preferably a metal foil, in particular an aluminium foil, and has a thickness of preferably between 6 μm and 50 μm. The sealing layer may be applied to this foil for example by being extrusion coated or laminated or painted. It is also possible here to lay a primer or laminating adhesive between the layers, in which case quantities of 0.5 to 5 g/m$^2$ dry are preferred.

Depending on the embodiment, the weakening lines or perforation lines may be introduced at different times or in different method steps; preferably, this is done in the foil that forms the reinforcing layer before it is joined to the induction layer and the other layers.

Joining the layers together in web form accordingly simplifies manufacture.

Various cut shapes are conceivable for the form of the weakening line or perforation. One possibility is a semicircular or polygonal shape that extends from the opening edge in the direction of the centre of the sealing disc and, when the sealing disc is pressed in in this central region and the cut-out portion is grasped in this central region, then allows it to be pulled off towards the edge.

However, it is possible to provide in the centre, as the weakening line or perforation, a circle which is not entirely closed and is then pressed in and shaped into a type of pull-out tab on which the user then pulls in order to be able to pull off the rest of the sealing disc, for example in the form of a direction of pulling that resembles a spiral. Since the weakening line extends as far as the edge region of the sealing disc on the mouth edge of the container, in this case too it is possible to utilise in each case to the optimum the force available to the user. The user can grasp the sealing disc in a fully controlled way and in this case pull the sealing disc in the sealing region off all around the mouth of the container successively one after the other.

However, other shapes are conceivable.

Thus, overall a preferably round sealing disc with no projecting opening tabs is produced. The sealing disc may thus be used in virtually any closure. It is not necessary to adapt the screw cap to particular projections or other properties of the sealing disc. Thus, there are no problems for companies filling the container with contents when the sealing disc is laid in the container lid, or for users when the containers are opened. The way the sealing disc behaves is entirely simple and self-explanatory to end consumers.

Consequently, the proposed opening aid lies within the sealing disc plane and also within the edge of the sealing disc without protruding outwards beyond this edge in any way. The weakening lines or perforation lines already make it possible to form the desired opening aid or hand grip. As a result of the weakening line, the end consumer can puncture or pull on the foil, to a certain extent also piercing it.

The weakening line may be made in a great variety of forms. For example, a continuous line may be provided which does not completely penetrate the layer concerned. It is also possible to equip this continuous line with corresponding interruptions, though these are of such short dimensions that overall separation may still be performed. The interruptions, that is to say the spacings between the sections of the weakening line, may in this case be of very different lengths, between approximately 0.05 and 5 mm.

It is also possible to construct the weakening line as a perforation line, that is to say as a plurality of points arranged in a row which overall form a weakening line, wherein the individual points are each at a small spacing from one other. Here too, the spacings may be between 0.05 and 5 mm. Spacings of less than 0.05 mm are already in the order of magnitude of the layer thickness and are both technically difficult to provide and indeed unnecessary. Spacings of more than 5 mm result in an unclean separation of the different sections along the weakening line. Any perforation holes are thus arranged at a predetermined and relatively closely adjacent spacing from one another. This weakening line or perforation line extends as far as the mouth edge of the container in all embodiments.

If the user has formed the hand grip him- or herself, he or she can pull the corresponding layer or foil of the sealing disc off the container mouth in one movement, and where appropriate thus pull off the entire the sealing disc, without residues remaining on the container mouth.

Should it be desirable for a part region of the sealing disc to be pulled up and for the rest of the foil composite to remain in place, that is also possible. In that case the weakening line is only made in this layer of the sealing disc and the other layers, underneath this layer having the weakening lines, are not damaged, either by the weakening line or by the opening procedure.

In a number of embodiments, an adhesion promoter may be located between the individual layers.

No additional foils or tapes are required to cover the predetermined later opening, which in any case already exists at the outset, until it is used. The opening is formed by the sealing disc itself. It is also a further advantage that the sealing disc is of the same thickness everywhere, over the entire surface region, unlike conventional tab constructions which operate with upwardly projecting or deployable folds. The hand grip for pulling off the sealing disc, or parts of the sealing disc, is actually only produced by the action of the end consumer at the moment when the end consumer wants to open the container and access the container contents.

Between the induction layer and the reinforcing layer that is provided with the weakening line or perforation, a further layer may be provided, in particular a foam foil. For this, a foam foil based on polyethylene or polypropylene having a thickness of preferably 15 μm to 250 μm has preferably proved particularly practicable.

In a preferred embodiment, it is provided for further layers to be provided and constructed such that they close the mouth of the container tight once the foil has been pulled off and the layers have been laid back on.

This additional element forms a so-called reseal part. It may in particular have a card or foam foil. The card or the foam foil may be coated or laminated on one or both sides with a plastics foil, for example plastics foils made from polyethylene terephthalate (PET), oriented polypropylene foil (OPP), high density polyethylene (HDPE), low density polyethylene (LDPE). Also possible is a coating with paper or card.

These reseal parts offer the possibility that, after the first opening by pushing through the weakening line or perforation and removing parts of or the whole sealing disc, the user can similarly also close the container by screwing the screw cap on again with the reseal part remaining therein. This means that at least a temporary tight closure is possible again.

This so-called reseal part may be connected to the reinforcing layers or the release coating thereon with the aid of a wax lamination or an extrusion lamination, and is then disconnected only when the screw cap is unscrewed for the first time.

In other embodiments, no connection of this reseal part to the layers underneath is provided from the outset, so the sealing disc is then in two parts.

Further preferred features can be found in the subclaims and the description of the Figures.

DESCRIPTION OF THE DRAWINGS

Exemplary embodiments of the invention will be explained in more detail below with reference to the drawing, in which.

DETAILED DESCRIPTION

Figure 1:
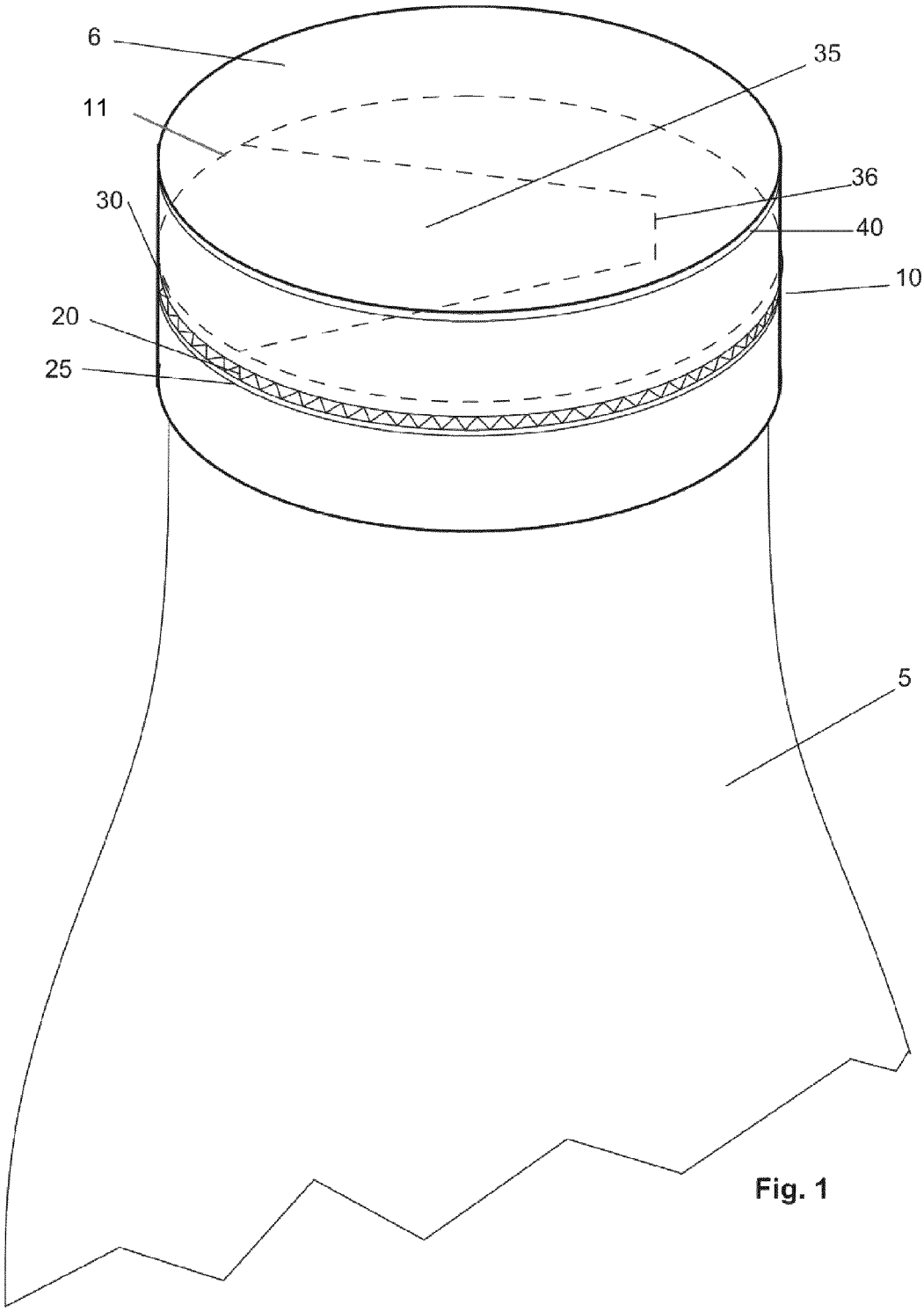
FIG. 1 shows a section through a container having a sealing disc according to the invention.

In the arrangement illustrated in FIG. 1 of a container 5 having a screw cap 6 and a sealing disc 10 positioned between the mouth of the container 5 and the screw cap 6, it can be seen that a plurality of layers or foils are arranged above one another for this sealing disc 10. The complete sealing disc 10 is mounted on the opening edge of a container 5, of which in particular the mouth is seen arranged schematically in section.

The container 5 may have a great variety of shapes. It may be made from glass or plastics or another material, and is filled (not illustrated) for example with a drink or a powder foodstuff or similar substances.

The mouth of the container 5 is usually, and in the majority of embodiments, circular. Accordingly, the opening edge of the container 5 is also circular, and the sealing disc 10 which is laid on the opening edge is overall in the shape of a circle and has an edge region 11 that forms a circular ring and corresponds approximately to the opening edge of the container 5.

The container 5 is closed by a screw cap 6, which is also indicated schematically. Before it is opened for the first time, the screw cap 6 is screwed securely closed, without interruption. At the first time of opening, in the embodiment illustrated the screw cap 6 is taken off for the first time by the end consumer. For this purpose, the end consumer twists the screw cap and removes it from the container 5.

The sealing disc 10 has, as a central element in the embodiment of the sealing disc illustrated, a foil 20 for inductively introducing heat into the sealing disc 10. This foil 20 is made from an electrically conductive material, in particular a metal, usually aluminium.

On the side facing the mouth of the container 5, this foil 20 is provided with a sealing layer 25. The sealing layer 25 thus lies on the opening edge, around the mouth of the container 5.

Once the container 5 has been filled with product, the entire sealing disc 10 is laid on the container mouth, or put in position there. Then, heat is introduced inductively into the sealing disc 10 and hence in particular also into the foil 20. This heat causes the entire sealing layer 25 to melt, in particular also in the edge region 11 of the sealing disc 10, that is to say where the sealing layer 25 lies directly on the edge of the mouth of the container 5. During this, this mouth of the container 5 is also heated.

Thus, in this region the sealing layer 25 is securely connected to the upper edge of the container 5. It is, as it were, sealed on.

On the side of the foil 20 that is remote from the opening edge around the mouth of the container 5 and the sealing layer 25, there is a further layer 30, which here serves as a reinforcing layer. This layer 30 is for example made from PET, BOPP, MOPP or OPA. It is securely mounted on the induction foil, in particular by means of extrusion lamination or lamination. It has a weakening line 36, which is indicated in FIG. 1 and will be explained below in more detail, for forming a hand grip 35.

Above this layer 30 there can be seen in FIG. 1 a further layer 40. This layer 40 is secured to the underside of the screw cap, for example being sealed on, glued on or mechanically clamped in.

After the container has been closed at the premises of the company filling it with contents, the screw cap 6 additionally keeps the entire sealing disc comprising the sealing layer 25, foil 20 for introducing heat, reinforcing layer 30 and additional layer 40 securely on the container.

When it is first opened, the screw cap 6 is taken off for the first time. Thus, the end consumer unscrews the container 5. During this, the layer 40, together with the screw cap 6, is freed from the beaker or container 5, with the sealing layer 25, foil 20 and reinforcing layer 30 remaining thereon, since any adhesive layer between the layer 30 and the layer 40 represents the weakest connection in the composite forming the sealing disc.

Figure 2:
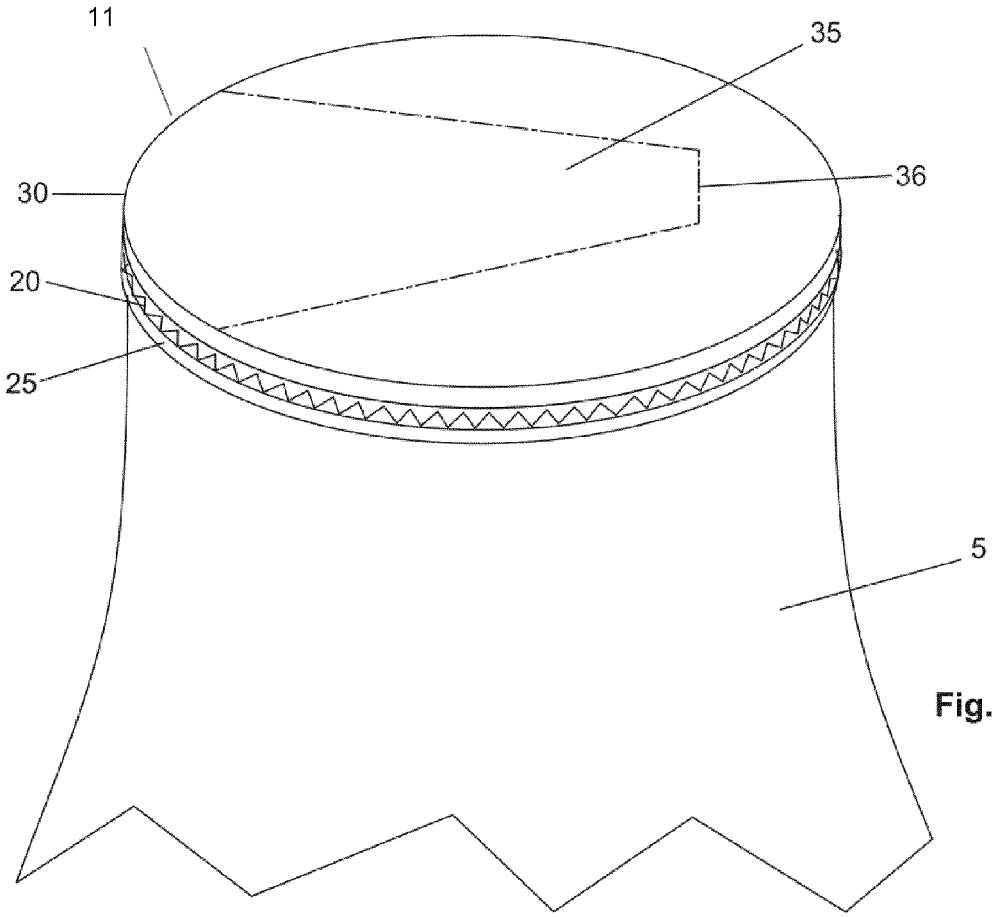
FIG. 2 shows a perspective illustration of a container from FIG. 1, during opening.

The resulting situation can readily be seen from FIG. 2, in perspective, where separation of the screw cap 6, at the top, from the container 5, at the bottom has already been performed. The user is now looking at the upper side of the uppermost layer, which still lies on the mouth of the container 5. This is the layer 30.

It can now readily be seen from this illustration that a hand grip 35 is marked out on the upper side of the layer 30, in a cut shape that is formed by the weakening lines 36 in the form of a perforation. The weakening line 36 extends into the edge region 11 of the sealing disc 10.

The user, who is now only separated from the product in the interior of the container 5, which is what is actually of interest, by the sealing disc 10, sees the weakening lines 36, where appropriate aided by pictograms or printing thereon, and has no difficulty in pushing a finger on these weakening lines 36 in a region which is as far away as possible from the edge region 11 and the mouth edge of the container 5, and through the sealing disc 10, with the reinforcing layer 30 which is deliberately weakened in this region, the induction foil 20 underneath and the in any case very thin and not secure sealing layer 25.

Figure 3:
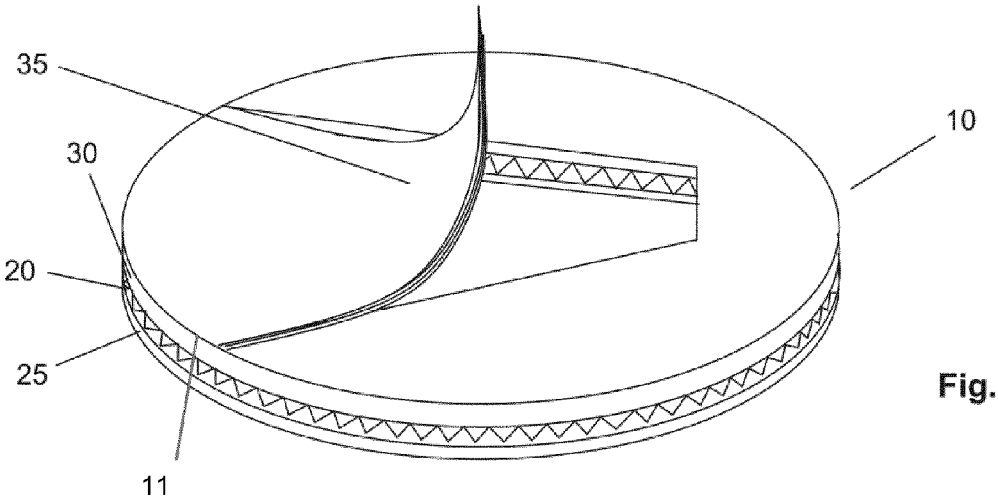
FIG. 3 shows an illustration similar to FIG. 2, in which the opening procedure is further advanced.

This situation can now readily be seen in FIG. 3. As a result of pushing through the sealing disc 10, the cut shape of the weakening line 36 produces a type of tab which was previously an integrated component part of the surface of the reinforcing layer 30.

Thus, unlike the case of conventional projecting folds or outwardly protruding tabs, this is not an additional component part of the surface or an additional, attached element of the sealing disc 10, but an integrated component part of the surface of one of the layers of the sealing disc 10, which does not project or jut upwards or outwards in any direction or stand out in any other way. At this point in time, this component part of the surface is still attached to the mouth edge of the container 5.

The user now grasps this hand grip 35, which is produced by pushing through the weakening lines 36, and pulls on it.

As a function of the actual construction and cut shape, the user simply pulls this hand grip 35 away as far as the edge region 11 of the sealing disc 10, and hence at the same time also reaches the opening edge of the container 5.

If the user then tears this hand grip 35 away completely from the opening edge of the container 5, by continuing to pull, he or she has automatically created an opening in the sealing disc 10 into which he or she can now introduce a teaspoon or from which he or she can, for example, pour a liquid by tilting the container 5.

The shape of the opening that is created is predetermined by the perforation and is precisely defined, and is also predictable to users, so there is no possibility of the product inside reacting in a surprising and unpredictable way by slopping over or similar. Moreover, the opening also delimits the mouth edge of the container 5.

In other embodiments, by grasping the hand grip 35 and pulling at an appropriate angle, the entire sealing disc 10, or the layers that are still on the opening edge of the mouth of the container 5, can be reached.

Figure 4:
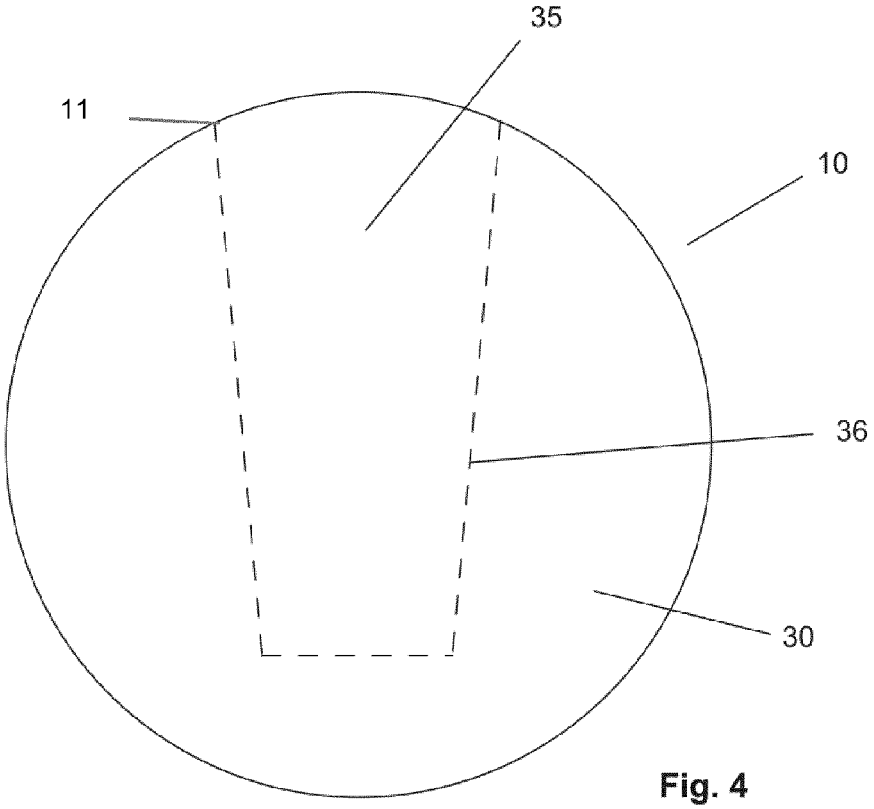
FIG. 4 shows a plan view of an embodiment of a sealing disc.

A first embodiment of the sealing disc 10 can be seen in FIG. 4, here illustrated in plan view. The user is met with this view once he or she has unscrewed the screw cap 6 from the container 5 and looks directly onto the sealing disc 10 from above. The user sees the uppermost layer, i.e. the reinforcing layer 30. The weakening line 36 which outlines the hand grip 35 here is marked out on this reinforcing layer 30.

In this embodiment, the user would for example press on the horizontal line which is shown at the bottom in the illustration, as a result of which it tears at the weakened line 36 and yields inwards in the direction of the container interior. Then, the user grasps the free end of this hand grip 35 that has been produced and pulls on it, thus pulling this hand grip 35 outwards and upwards out of the container interior again, and then pulling it off completely.

Then, along the weakening line 36 this hand grip 35 tears completely out of the rest of the surface of the sealing disc 10.

Although the perforation or weakening line 36 is located only in the reinforcing layer 30, the significantly weaker induction layer 20 and, to an even greater extent, any further layers present, such as the sealing layer 25, are automatically torn away with it, since they are connected to the reinforcing layer 30 and in themselves have significantly less material strength.

Figure 5:
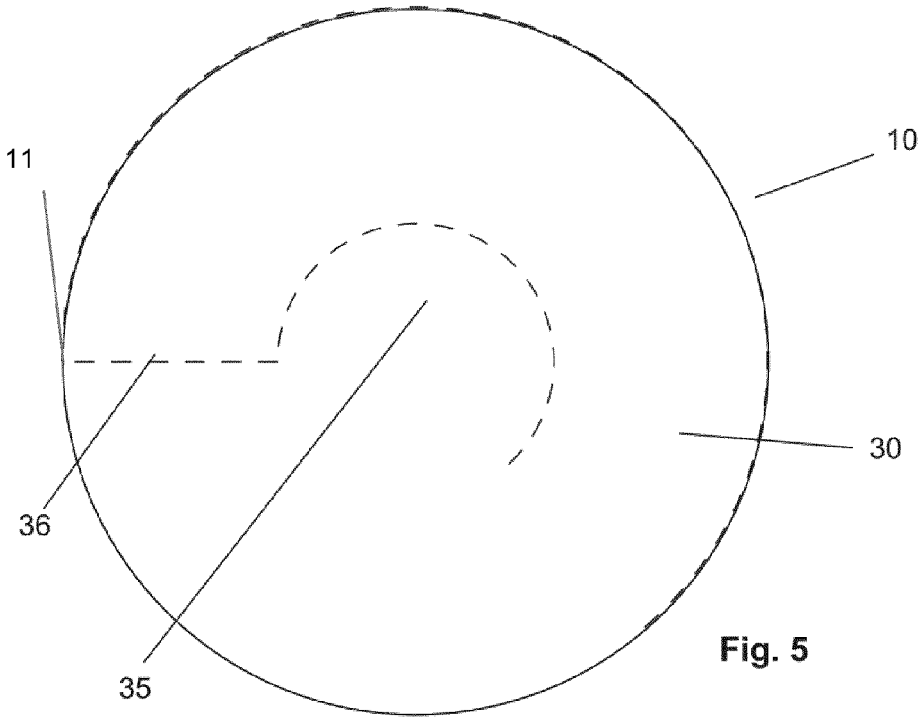
FIG. 5 shows a plan view of another embodiment of a sealing disc.

FIG. 5 illustrates a further embodiment. Here, it is seen that once more there is marked out in the central region of the surface of the sealing disc 10, on the reinforcing layer 30, a weakening line 36 which here forms a type of incomplete circle. This incomplete circle is then connected, by way of the weakening line 36, to the edge region 11 of the sealing disc 10 at the mouth of the container 5.

Once again, this incomplete circle may be pushed in the direction of the interior of the container 5 by the user's finger. Once again, this produces a hand grip 35 on which the user can pull. By pulling on the hand grip 35 in a manner which is deft but at the same time readily comprehensible to the user, in a direction parallel to the periphery of the mouth of the container 5, the user can free the compete sealing disc 10 from the mouth of the container 5. The action of force by the end consumer is in this case performed such that, successively, the still sealed-on section of the edge region 11 of the sealing disc 10 is freed and this allows the next section to be freed.

Looking back at FIG. 1, it can now be seen that at the top on the reinforcing layer 30, above the weakening line 36, there may also be a release coating which allows simplified separation of the reinforcing layer 30 and the layers underneath from the further layers 40 located above, which form the so-called reseal part, to make it possible to close the opening again.

Further, it is also possible for a foam foil 32, in particular a foam foil 32 made from polyethylene or polypropylene, to be located between the reinforcing layer 30 and the induction foil 20.

LIST OF REFERENCE NUMERALS

5 Container
6 Screw cap
10 Sealing disc
11 Edge region of the sealing disc
20 Foil for inductive introduction (metal foil)
25 Sealing layer
30 Reinforcing layer
35 Hand grip
36 Weakening line
40 Layer on underside of screw cap (reseal part)

What is claimed is:

1. A sealing disc for closing a mouth of a container comprising;

an edge region of the sealing disc, a foil for inductively heating the sealing disc, a sealing layer on the side of the foil that is to face the interior of the container, said foil inductively heating the sealing layer for sealing tight the edge region of the sealing disc on the mouth of the container, a reinforcing layer on the side of the foil that is remote from the sealing layer, a hand grip that is formed as part of the sealing disc, for opening the mouth of the container that is closed by the sealing disc, said reinforcing layer provided with weakening lines for forming an outline of the hand grip, and at least one of the weakening lines leads into the edge region of the sealing disc.

2. A sealing disc according to claim 1, characterised in that the foil is a metal foil.

3. A sealing disc according to claim 1, characterised in that the layers on the side of the foil remote from the sealing layer have a foil of polyethylene terephthalate (PET foil) and/or a foil of monoaxially oriented polypropylene (MOPP foil) and/or a foil of biaxially oriented polypropylene (BOPP foil) and/or a foil of oriented polyamide (OPA foil).

4. A sealing disc according to claim 1, characterised in that the weakening lines are in the form of a perforation which has a linear arrangement of individual perforation holes which takes the form of an opening aid.

5. A sealing disc according to claim 1, characterised in that the weakening lines are provided only and precisely in the reinforcing layer.

6. A sealing disc according to claim 1, characterised in that a surface piece of the reinforcing layer that is delimited by the weakening lines and the edge region of the sealing disc is removable in one movement.

7. A sealing disc according to claim 1, characterised in that a release coating is applied above the reinforcing layer.

8. A sealing disc according to claim 1, characterised in that, between the foil and the reinforcing layers, a foam foil is arranged comprising polyethylene or polypropylene.

9. A sealing disc according to claim 1, characterised in that further layers are provided and configured such that they close the mouth of the container tight once the foil has been removed and the layers have been laid back on.

10. A sealing disc according to claim 9, characterised in that the further layers have a support layer made from a foamed polymer or from cardboard.

11. A sealing disc according to claim 9, characterised in that the layers on the side of the foil that is remote from the sealing layer and above the layer having the weakening lines are freed from the layer by the action of heat at a manufacturer's premises, at the stage once a procedure of filling and closing the container is complete.

12. A container, having a mouth which is closed by a sealing disc according to claim 1.

13. A container according to claim 12, characterised in that at least one of the weakening lines leads to an outer edge of the mouth of the container.

14. A container according to claim l wherein the foil is an aluminum foil.

15. A sealing disc according to claim 1, further including a support layer disposed on a side of the reinforcing layer remote from the foil, and a cap screw for holding the support layer.

16. A sealing disc according to claim 15, wherein the weakening lines are provided only in the reinforcing layer and the weakening lines of the reinforcing layer form the hand grip as a hand grip portion of the reinforcing layer surrounded by a secured portion of the reinforcing layer.

17. A sealing disc according to claim 16, characterised in that both the hand grip portion and the secured portion are integrally formed, with the hand grip portion being grasped for pulling away from the secured portion at the weakening lines to create an opening for access to an interior of the container, while the secured portion of the reinforcing layer remains attached to the mouth of the container as the hand grip portion is pulled.

18. A sealing disc according to claim 17, wherein, before the hand grip portion is pulled away, the hand grip portion and the secured portion are integrally co-planar.

19. A sealing disc according to claim 18, wherein the hand grip portion is disposed within the bounds of the mouth of the container.

20. A sealing disc according to claim 19, wherein the container is re-sealed by screwing the screw cap onto the container so that the support layer again seals against the remaining secured portion of the reinforcing layer and the opening.

21. A sealing disc according to claim 20, wherein the foil and sealing layer disposed under the hand grip are also detached with the hand grip portion in order to form the opening.

* * * * *